US005217339A

United States Patent [19]

O'Connor et al.

[11] Patent Number: 5,217,339

[45] Date of Patent: Jun. 8, 1993

[54] NON-SEATING PLATE/FASTENER ASSEMBLY

[75] Inventors: Terence J. O'Connor, Overland Park, Kans.; Charles J. DeCaro, Charlotte, N.C.

[73] Assignee: Performance Building Products, Inc., Kansas City, Kans.

[21] Appl. No.: 906,662

[22] Filed: Jun. 30, 1992

[51] Int. Cl.[5] ..... F16B 39/24; F16B 43/00; E04B 5/00

[52] U.S. Cl. ..... 411/531; 411/161; 411/533; 411/959; 52/410

[58] Field of Search ..... 411/368, 160, 161, 187, 411/188, 531, 533, 958, 959; 52/410, 512

[56] References Cited

U.S. PATENT DOCUMENTS

| | | | |
|---|---|---|---|
| 2,147,209 | 2/1939 | Olson | 411/187 |
| 2,292,557 | 8/1942 | Wilson . | |
| 3,077,218 | 2/1963 | Ziegler | 411/161 X |
| 4,074,501 | 2/1978 | Sandqvist . | |
| 4,275,541 | 6/1981 | Orals et al. . | |
| 4,361,997 | 12/1982 | DeCaro | 411/161 X |
| 4,380,413 | 4/1983 | Dewey | 411/531 |
| 4,455,804 | 6/1984 | Francovitch . | |
| 4,630,984 | 12/1986 | Reinwall et al. | 411/533 X |
| 4,653,244 | 3/1987 | Farrell . | |
| 4,726,164 | 2/1988 | Reinwall et al. . | |
| 4,781,503 | 11/1988 | Bogel . | |
| 4,787,188 | 11/1988 | Murphy . | |
| 4,959,938 | 10/1990 | DeCaro | 52/410 |
| 4,987,714 | 1/1991 | Lemke | 52/410 |

*Primary Examiner*—Neill R. Wilson

*Attorney, Agent, or Firm*—Kokjer, Kircher, Bowman & Johnson

[57] ABSTRACT

An improved plate/fastener assembly includes an elongated fastener having a first set of threads adjacent the tip and a second set of threads adjacent the head. The first set of threads has a diameter smaller than that of the second. The fastener is employed with a plate which includes a stress plate portion having a hub extending downwardly therefrom. The hub includes an opening extending therethrough which receives the fastener. The first set of threads will engage with a metal roof deck to hold the fastener in place, while the second set of threads engages with the plate to hold the plate in place. The lower face of the plate includes a plurality of ribs adapted to engage with an insulation material to prevent rotation of the plate. Each of the ribs presents a concave configuration in the direction of rotation of the plate to disengage same from the fastener. The ridges have a triangular cross-section, with a first face which will oppose this loosening rotation of the plate forming a smaller angle with respect to the bottom face of the plate than does the other face. The plate may also include a plurality of circumferentially spaced hub ribs which extend in the longitudinal direction of the hub on its outer face. These hub ribs also serve to resist rotation of the plate.

19 Claims, 2 Drawing Sheets

NON-SEATING PLATE/FASTENER ASSEMBLY

BACKGROUND OF THE INVENTION

1. Field of the Invention

The present invention relates in general to roofing systems. In particular, the present invention relates to an improved plate for use in a plate/fastener assembly employed to secure insulation material to a roof deck.

2. Description of the Related Art

It is known to form roof systems by providing a metal roof deck. To provide protection against the elements and a thermal barrier, a layer of insulation material is placed over the metal roof deck and secured thereto by plate/fastener assemblies. These assemblies consist of a metal or plastic plates to spread the load of a fastener, which extends through the plate and insulation and is fixed to the metal roof deck. Plies of synthetic coating, tar, gravel or various roofing materials are then applied over the insulation and plate/fastener assemblies to complete the roof.

While this arrangement has been serviceable, various problems have been experienced with the plate/fastener assemblies. For example, it is difficult to maintain the fastener normal to the roof deck during insertion, the fastener is susceptible to overdriving resulting in an excessive load being exerted on the plate which leads to premature loosening, and the weight of a worker walking upon the roof may cause the plate to slide down along the fastener, such that the head of the fastener damages the coating plies which complete the roof.

Many of these problems have been solved by a plate/-fastener assembly as shown in U.S. Pat. Nos. 4,361,997, issued Dec. 7, 1982, and 4,959,938, issued Oct. 2, 1990, both to DeCaro. The assembly shown in these patents includes a plate formed of plastic which essentially consists of a stress plate having a hub extending down from the bottom surface of the stress plate. The hub includes a central opening having a first diameter to receive the fastener therethrough. The fastener is an elongated member having two sections of threads. The first section of threads has a diameter such that it will pass through the opening in the hub without engagement, yet maybe employed to secure the fastener to the roofing deck. The second set of threads is adjacent the head of the fastener and has a diameter such it they will engage with the opening in the hub. This will prevent the sliding of the plate along the fastener, and additionally helps to prevent over driving of the fastener.

While this arrangement has been an improvement over other plate/fastener assemblies, it is still possible for the plate to rotate with respect to the fastener, causing loosening and possibly disengagement of the plate from the fastener. As may be envisioned, this will threaten the integrity of the roofing plies, and possibly allow the insulation to separate from the roofing deck.

SUMMARY OF THE INVENTION

An object of the present invention is to provide a plate/fastener assembly which will securely maintain an insulation material to a roofing deck without damage to overlying roofing plies.

Another object of the present invention is to provide a plate/fastener assembly which will aid in aligning the fastener as it penetrates the insulation and metal roof deck.

Yet another object of the present invention is to provide a plate/fastener assembly having an improved plate structure which resists rotational movement which would tend to disengage the plate from the fastener.

A further object of the present invention is to provide such a plate/fastener assembly which includes means for permitting the engagement of a tool with the plate for rotating the plate.

These and other objects are achieved by our improved plate/fastener assembly. The assembly includes an elongated fastener having a first set of threads adjacent the tip of the fastener and a second set of threads adjacent the head of the fastener. The first set of threads has a diameter smaller than that of the second. The fastener is employed with a plate which includes a stress plate portion having a hub extending downwardly therefrom. The hub includes an opening extending therethrough which receives the fastener. The opening has a diameter equal or greater to that of the first set of threads, but smaller than that of the second set of threads. The first set of threads will engage with a metal roof deck to hold the fastener in place, while the second set of threads engages with the plate to hold the plate in place. The lower face of the plate includes a plurality of ribs adapted to engage with an insulation material to prevent rotation of the plate with respect to the fastener. These ribs extend from the hub to a position adjacent the outer periphery of the plate. Each of the ribs has a curvilinear shape, in the peripherally outward direction, to present a concave configuration in the direction of rotation of the plate necessary to disengage same from the fastener. The ridges have a substantially triangular cross-sectional configuration, with a first face which will oppose this loosening rotation of the plate. This first face forms a smaller angle with respect to the bottom face of the plate than does the other face. The plate may also include a plurality of circumferentially spaced hub ribs which extend in the longitudinal direction of the hub on its outer face. These hub ribs also serve to resist rotation of the plate.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 4:
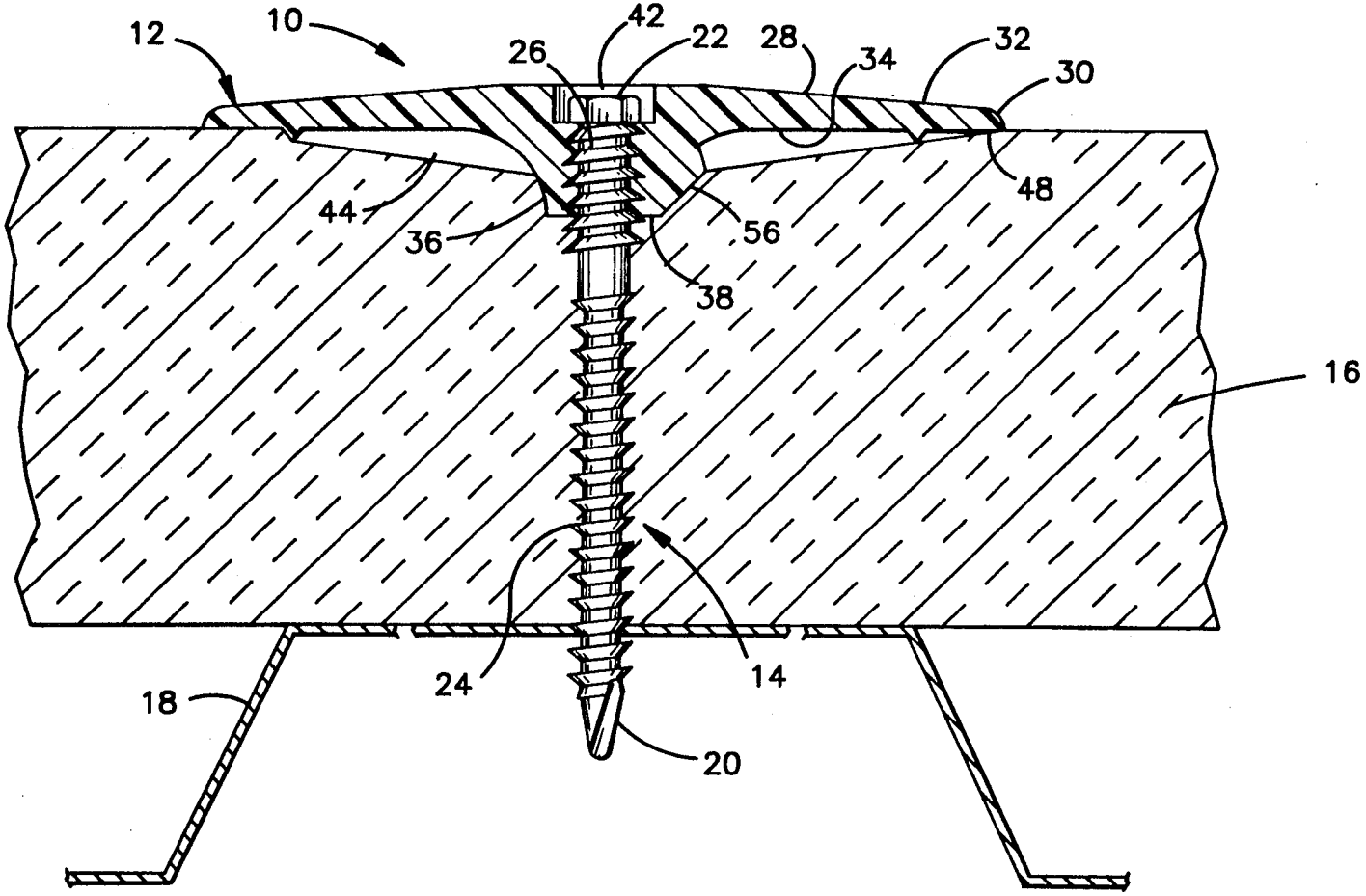
FIG. 4 is a partial cross-sectional view showing the installed assembly according to the present invention, with the plate being a cross sectional view along line 4—4 of FIG. 1.

With reference to FIG. 4, a plate/fastener assembly according to the present invention is generally designated by reference numeral 10. The assembly 10 essentially consists of a plate 12 and a fastener 14. FIG. 4 shows the assembly 10 in the installed position, with the fastener 14 extending through a mass of insulation 16 and fixed to a metal deck 18. The insulation 16 rests upon the upper surface of the deck 18, with the plate 12 in abutment with the upper surface of the insulation 16 and fixed to the fastener 14. As such, the assembly 10 serves to maintain the insulation 16 in place on the upper surface of deck 18.

The fastener 14 is an elongated member having a tip 20 and head 22. The fastener 14 also includes first and second sets of threads 24 and 26, respectively, with the first set of threads being located adjacent the tip 20 and the second set of threads adjacent the head 22. As disclosed in above noted U.S. Pat. No. 4,959,938, which is included herein by reference, the outer diameter of the first set of threads 24 is smaller than that of the second set of threads 26. The reason for this difference in diameter will become apparent from the discussion below. The tip 20 of the fastener may be formed such that the first set of threads 24 are self-tapping, with the head 22 being adapted to be engaged by an appropriate tool (not shown) for driving the fastener into engagement with the deck 18.

The improved plate 12 according to the present invention includes a stress plate portion 28 having an outer periphery 30. The portion 28 preferably has a slight downward concave configuration (in the direction of insulation 16) to strengthen the plate portion and aid in resisting upward movement of the insulation.

The plate portion 28 defines an upper surface 32 and a lower surface 34. A hub 36 extends downwardly (towards the insulation in the installed position of FIG. 4) from the lower surface 34. The hub 36 is preferably located substantially centrally of the plate portion, and is tapered inwardly towards a free or lower end 38 to allow the plate 12 to more easily conform to the upper surface of insulation 16 without damaging such insulation. This effect may be further improved by forming a smooth transition between the hub 36 and the lower surface 34 of the plate portion.

An opening 40 extends through the hub 36 and is adapted to receive the fastener 14. The opening 40 preferably opens into a cavity 42 formed in the upper surface 32 of plate portion 28. A first purpose of this cavity 42 is allow the head 22 of the fastener 12 to be located below the upper surface 32 of the plate portion 28 to provide a smooth surface for the plies of material to be applied over the assembly 10. Additional reasons for forming the cavity 42 will be discussed below.

As noted above, the first set of threads 24 has an outer diameter smaller than that of second set of threads 26. The opening 40 preferably has a diameter equal to or greater than that of the first set of threads 24. This will allow the threads 24 to pass through the opening 40 freely to place the tip 20 in proximity to the deck 18. The second set of threads 26, however, has a diameter such that it will engage with the opening 40.

As described in the above noted U.S. Pat. No. 4,959,938, the elongated nature of opening 40 (due to presence of hub 36) will serve to properly align the fastener to a position substantially normal to the deck 18. As the fastener 14 is driven, the tip 20 will tap into the deck 18 and the first set of threads 24 will engage therewith. Shortly thereafter the second set of threads 26 will engage with the opening 40, with further rotation of fastener 14 serving to move the fastener downwardly with respect to the plate to recess the head 22 within cavity 42. This arrangement will prevent overtightening of the assembly 10, and at the same time will ensure that the plate 12 is securely fixed against movement in the direction of the longitudinal axis of fastener 14.

As should be apparent, to enable engagement of the second set of threads 26 with the plate 12, the plate 12 must be substantially stationary during rotation of the fastener. To prevent rotation of the plate 12 with the fastener, the plate according to the present invention is provided with abutment means to engage with the insulation 16.

Figure 1:
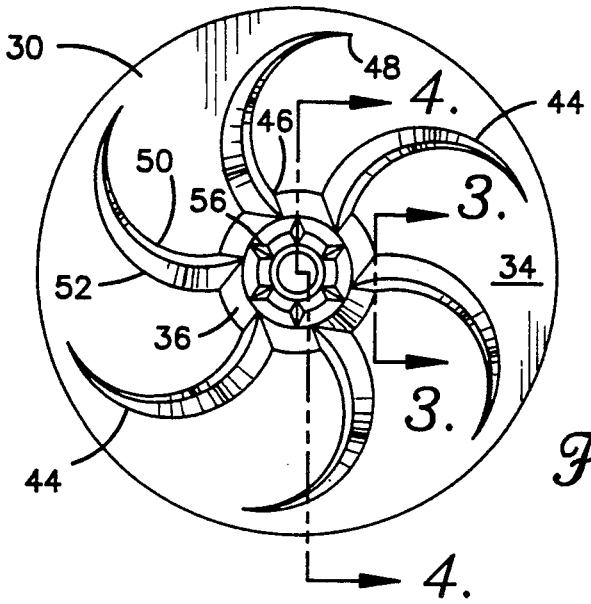
FIG. 1 is a bottom view of a plate according to the present invention.

Specifically, this abutment means includes a plurality of circumferentially spaced ribs 44 extending downwardly from the lower surface 34 of the plate portion 28. As is best shown in FIG. 1, each of the ribs includes an inner end 46 which abuts against the hub 36 and an outer end 48 in proximity to the outer periphery 30. While it has been known to provide linear ribs which extend radially outward from the hub, the ribs 44 according to the present invention have a curvilinear shape. By forming the ribs with such a curvilinear shape, the length of the ribs is lengthened in comparison to a linear configuration having inner and outer ends at equivalent points. This increased rib length provides greater surface area for engagement with the insulation 16, and thus greater resistance to rotation about the longitudinal axis of fastener 14.

While various curvilinear shapes could be provided, it is preferred that the ribs 44 form an arcuate section with the concave side oriented in a direction of rotation of the plate 12, with respect to the fastener 14, which would cause the plate 12 to be moved upwardly away from the insulation 16.

In keeping with the reasons for tapering the hub 36, the ribs 44 extend downwardly from the lower surface a greater distance adjacent the inner ends 46 than adjacent the outer ends 48, such that the ribs taper upwardly towards the outer periphery 30.

In the installed configuration of FIG. 4, the ribs 44 will compress the insulation 16, which is typically at least slightly resilient. This compression will be localized in the area of the ribs, such that the insulation will extend above the lower edge of the ribs in the spaces between the ribs. It is the abutment of the ribs against these upwardly extending portions of the insulation which provides a great deal of the resistance against rotation. To improve resistance against rotation, the ribs according to the present invention are preferably formed with a cross-sectional configuration which will exploit this principal to increase the resistance of the plate against loosening.

Figure 3:
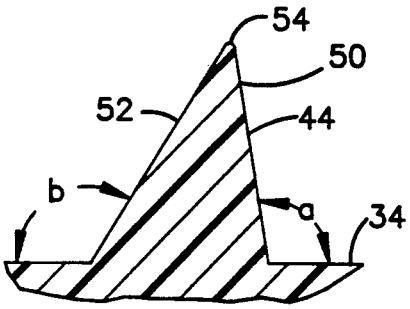
FIG. 3 is a detail cross sectional view along line 3—3 of FIG. 1.

Specifically, as best shown in FIG. 3, the ribs 44 may have a triangular cross-sectional configuration to define a first side face and second side face 50 and 52, and an apex 54. The apex 54 is preferably slightly rounded to prevent damage to the insulation 16. To increase resistance of the plate against rotation in the direction of loosening, the first side face 50 is formed with an angle a with respect to the lower surface 34 which is smaller than an angle b formed between the second side face 52 and the lower surface 34. This reduced angle will reduce the vertical component of force exerted upon the rib by the insulation, and thus lessen the possibility of the rib forcing the insulation downward to allow rotation of the rib in a direction in which the first side face 50 is leading. In other words, if a mass of insulation 16 were pressed downwardly upon the rib 44 of FIG. 3 it would require less force to move the rib to the left than to move the rib to the right.

While the above described rib configuration is believed to provide improved results over linear ribs having a triangular configuration with side faces of equal length, further means may be provided to aid in resisting rotation of the plate with respect to the fastener.

Specifically, the plate 12 may be provided with a plurality of circumferentially spaced hub ribs 56. The hub ribs 56 extend peripherally outward from the exterior of the hub 36 to aid in preventing rotation in a manner similar to that described for the ribs 44. As any localized depressions in the insulation 16 caused by the hub ribs 56 may reduce the amount of insulation 16 lodged between the ribs 44, thus reducing the effect of the ribs 44, the placement of the hub ribs is believed important. The hub ribs 56 are preferably formed with a number equal to the number of ribs 44, and may be substantially aligned with the inner ends 46 of the ribs 44, or maybe placed at positions intermediate adjacent ones of the inner ends 46, as shown in FIG. 1.

In keeping with the tapered configuration of hub 36, the hub ribs 56 preferably taper outwardly towards the upper surface 32 of plate portion 28, as is best illustrated in FIG. 4. Upon review of FIG. 4, it may be seen that where the hub ribs 56 are placed intermediate the ribs 44 (as in FIG. 1) the localized depression in the insulation caused by the upper ends of the hub ribs may reduce the effect of the ribs 44. As such, in such an arrangement it is preferred that the ribs do not extend the entire length of the hub 36, and in particular are spaced from the lower surface 34 of plate portion 28.

While the hub ribs 56 could have various cross sectional configurations, it is preferred that they have a triangular configuration. While the hub ribs 56 of FIG. 1 have been shown with side faces of equal length, the hub ribs 56 could be formed with unequal side faces, in a manner similar to that shown in FIG. 3, to increase the resistance against rotation in one direction compared to the other.

Figure 2:
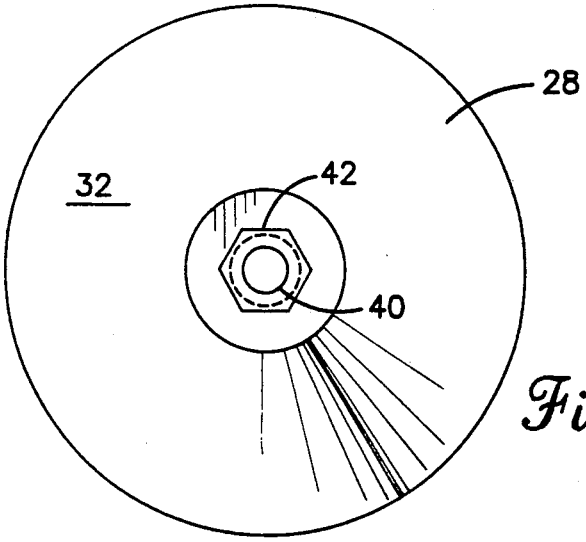
FIG. 2 is a top view of the plate of FIG. 1.

With the improvements described above for the plate 12 according to the present invention, it may be found that the plate 12 is so resistant to loosening rotation that it is difficult for a worker to rotate the plate 12 to remove same from the fastener 14 should this be necessary. To aid in such removal the plate according to the present invention is provided with manually engageable means for assisting in rotation of the plate 12. In particular, the cavity 42 which receives the head 22 of the fastener 14 maybe provided with a hexagonal shape as is best shown in FIG. 2. As such, a worker could insert an appropriately shaped tool to engage with the cavity 42 to allow rotation in either direction. Additionally, forming the cavity 42 with such a tool engaging periphery may allow the tool which applies the fastener 14 to engage with the plate 12, to prevent rotation of the plate with respect to the fastener during the installation process.

To reduce manufacturing costs the plate 12 according to the present invention is preferably formed as a monolithic unit. While the plate could be formed of a metal having threads formed, or formable, within the opening 40, it is preferred that the plate be formed as a monolithic plastic unit for a reduced cost and improved corrosion resistance. The plastic should of course be of a variety which will allow the second set of fastener threads to tap the opening during installation.

While the present invention has been described with regard to a particular embodiment, it should be apparent to those skilled in the art that various modifications could be made without departing from the scope of the invention. For example, while the plate according to the present invention has been shown with a round periphery and reference has been made to circumferential directions, the periphery 30 of the plate 12 could have other configurations. Additionally, a greater or lesser number of ribs or hub ribs 56 could be employed. As a further variation, the shape of the cavity need not be hexagonal, but may be any tool engageable shape. If for some reason, it is necessary to replace a plate within an existing assembly, a new plate can be threaded over the thread that is adjacent to the head, eliminating the need to replace the fastener.

From the foregoing it will be seen that this invention is one well adapted to attain all ends and objects hereinabove set forth together with the other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A plate for a roofing fastener assembly, comprising:

a stress plate portion having an outer periphery and upper and lower surfaces;

a hub extending downwardly from said lower surface at a substantially central location thereon;

an opening extending through said hub and adapted to receive a fastener therethrough;

a plurality of ribs extending downwardly from, and spaced peripherally about, said lower surface, said ribs having peripherally inner ends in proximity to said hub, and peripherally outer ends in proximity to said outer periphery, and each said rib extending in a curvilinear configuration between associated ones of said inner and outer ends.

2. A plate as in claim 1, wherein said curvilinear configuration is a section of an arc.

3. A plate as in claim 2, wherein each of said ribs has first and second side faces to define a substantially triangular cross-sectional configuration.

4. A plate as in claim 3, wherein said opening is adapted to threadedly engage with the fastener such that rotation of said plate with respect to the fastener will cause upward movement of said plate with respect to the fastener, and wherein said first side face is shorter than said second side face, whereby an angle between said first side face and said lower surface is smaller than an angle between said second side face and said lower surface, said first side face leading when said plate is rotated with respect to the fastener in said first direction.

5. A plate as in claim 4, further including a plurality of hub ribs extending peripherally outward from, and peripherally spaced about, said hub.

6. A plate as in claim 5, further including a cavity opening onto said upper surface and encompassing said opening, whereby a head of the fastener may be received within said cavity, said cavity having a peripheral configuration capable of being engaged with a tool for applying a rotational moment to said plate.

7. A plate as in claim 5, wherein said hub ribs extend from a first end in proximity to a free end of said hub to a second end spaced from said lower surface.

8. A plate as in claim 7, further including a cavity opening onto said upper surface and encompassing said opening, whereby a head of the fastener may be received within said cavity, said cavity having a peripheral configuration capable of being engaged with a tool for applying a rotational moment to said plate.

9. A plate as in claim 1, wherein each of said ribs has first and second side faces to define a substantially triangular cross-sectional configuration.

10. A plate as in claim 9, wherein said opening is adapted to threadedly engage with the fastener such that rotation of said plate with respect to the fastener will cause upward movement of said plate with respect to the fastener, and wherein said first side face is shorter than said second side face, whereby an angle between said first side face and said lower surface is smaller than an angle between said second side face and said lower surface, said first side face leading when said plate is rotated with respect to the fastener in said first direction.

11. A plate as in claim 10, further including a plurality of hub ribs extending peripherally outward from, and peripherally spaced about, said hub.

12. A plate as in claim 11, further including a cavity opening onto said upper surface and encompassing said opening, whereby a head of the fastener may be received within said cavity, said cavity having a peripheral configuration capable of being engaged with a tool for applying a rotational moment to said plate.

13. A plate as in claim 11, wherein said hub ribs extend from first end in proximity to a free end of said hub to a position spaced from said lower surface.

14. A plate as in claim 13, further including a cavity opening onto said upper surface and encompassing said opening, whereby a head of the fastener may be received within said cavity, said cavity having a peripheral configuration capable of being engaged with a tool for applying a rotational moment to said plate.

15. A plate as in claim 1, further including a plurality of hub ribs extending peripherally outward from, and peripherally spaced about, said hub.

16. A plate as in claim 15, further including a cavity opening onto said upper surface and encompassing said opening, whereby a head of the fastener may be received within said cavity, said cavity having a peripheral configuration capable of being engaged with a tool for applying a rotational moment to said plate.

17. A plate as in claim 15, wherein said hub ribs extend from a first end in proximity to a free end of said hub to a second end spaced from said lower surface.

18. A plate as in claim 17, further including a cavity opening onto said upper surface and encompassing said opening, whereby a head of the fastener may be received within said cavity, said cavity having a peripheral configuration capable of being engaged with a tool for applying a rotational moment to said plate.

19. A plate for a roofing fastener assembly, comprising:

a stress plate portion having an outer periphery and upper and lower surfaces;

a hub extending downwardly from said lower surface at a substantially central location thereon;

an opening extending through said hub and adapted to receive therethrough and to threadedly engage with a fastener such that rotation of said plate with respect to the fastener will cause upward movement of said plate with respect to the fastener;

a plurality of ribs extending downwardly from, and spaced peripherally about, said lower surface, said ribs having peripherally inner ends in proximity to said hub, and peripherally outer ends in proximity to said outer periphery, and each said rib having first and second side faces to define a substantially triangular cross-sectional configuration, said first side face being shorter than said second side face, whereby an angle between said first side face and said lower surface is smaller than an angle between said second side face and said lower surface, said first side face leading when said plate is rotated with respect to the fastener in said first direction.

* * * * *